United States Patent [19]

Bratt et al.

[11] 4,335,653

[45] Jun. 22, 1982

[54] ELECTRIC IGNITER WITH CONDUCTIVE BODIES AND THIN CONNECTOR

[75] Inventors: Sven-Erik Bratt, Karlskoga; Kurt Nygaard, Niederhasli; Olof Nygards, Karlskoga, all of Sweden

[73] Assignee: Aktiebolaget Bofors, Bofors, Sweden

[21] Appl. No.: 183,670

[22] Filed: Sep. 2, 1980

[30] Foreign Application Priority Data

Sep. 3, 1979 [SE] Sweden ..... 7907294

[51] Int. Cl.[3] ..... F42C 19/12

[52] U.S. Cl. ..... 102/202.8; 102/202.9

[58] Field of Search ..... 102/202.6, 202.8, 202.9

[56] References Cited

U.S. PATENT DOCUMENTS

| | | | |
|---|---|---|---|
| 3,295,446 | 1/1967 | Harnau | 102/202.8 X |
| 3,390,636 | 7/1968 | Perkins et al. | 102/202.8 X |
| 3,719,148 | 3/1973 | Gawlick et al. | 102/202.9 X |
| 3,725,671 | 4/1973 | Keister et al. | 102/202.8 X |
| 4,014,264 | 3/1977 | Bendler et al. | 102/202.6 |
| 4,156,390 | 5/1979 | Ferguson et al. | 102/202.8 |
| 4,267,567 | 5/1981 | Nygaard et al. . | |

*Primary Examiner*—Peter A. Nelson

*Attorney, Agent, or Firm*—Pollock, Vande Sande & Priddy

[57] ABSTRACT

The present invention relates to an electric igniter of the type comprising two electrically conductive bodies separated by an insulating body. The conductive bodies and said insulating body define a very smooth common surface having a thin connective member electrically connecting the conductive bodies. A pyrotechnic charge is in contact with said thin connective member for ignition when said member is heated by a flow of electric current therethrough. The connective member comprises one or more thin metal layers which are bonded to said smooth surface. In order to give the igniter a somewhat "slower" electrical response as well as increasing the mechanical strength of the connective member. The connective member also comprises an additional thin layer of inert material, preferably a glass- or $SiO_2$-layer, applied directly on the upper metal layer.

6 Claims, 2 Drawing Figures

ELECTRIC IGNITER WITH CONDUCTIVE BODIES AND THIN CONNECTOR

Figure 1:
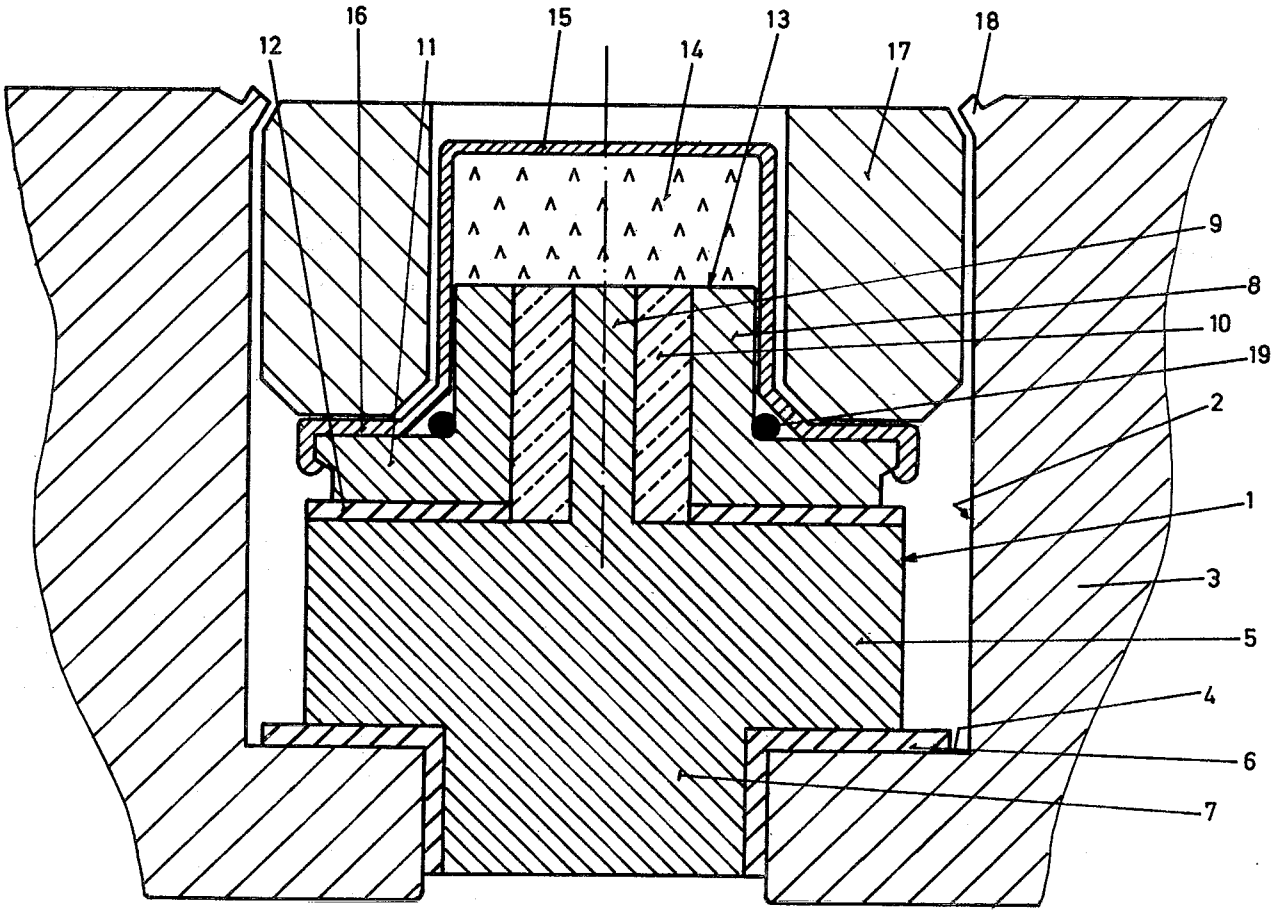

The present invention relates to an electric igniter of the type comprising two electrically conductive bodies separated by an insulating body, preferably made of glass or a ceramic material, the conductive bodies and said insulating body defining a common surface having a thin connective member electrically connecting the conductive bodies. A pyrotechnic charge is in contact with the thin connective member for ignition when said member is heated by a flow of electric current therethrough.

An electric igniter of this type is shown in British Patent Application No. 15512/78. According to this application the conductive bodies, the insulating body and the connective member are bonded together in a mechanically strong connection which is substantially unaffected by temperature variations in the bodies. The thin connective member comprises at least one thin metal layer applied directly on the very smooth surface of the bodies and is so dimensioned that its resistance and heat generation can be accurately determined. In such an igniter it is also important that the pyrotechnical composition is in direct contact with the connective member and the surface of the bodies under a comparatively high pressure.

An electric igniter of this type can be used in various kinds of ammunition and is detonated by electricity. For example an electric igniter can be used to detonate a projectile in which an electrically charged capacitor is connected to the igniter by an impact contact or similar means.

Such igniters provide very rapid detonation and make it also possible to accurately determine the detonation time. The igniters are also designed to withstand comparatively strong mechanical stresses. The fact that the electrical properties of the igniters can be so accurately determined leads to a reduction of accidental ignition which has previously been a problem.

Even if the igniters then have outstanding electrical and mechanical properties, there are some applications, however, in which the properties of the igniters have proved to be insufficient.

In some applications it is desirable to use electric igniters which can be detonated after a longer time than the detonation times of a few microseconds which is a characteristic of the above mentioned igniters. The reason for a somewhat "slower" electric igniter is the desire to increase the safety against accidental ignition caused by electrostatic energy.

For electric igniters used in fuzes for artillery ammunition it has also proved difficult to achieve sufficient mechanical strength of the metal layers due to the extremely high instantaneous retardations which will arise in the igniter during the ramming of the ammunition round when the shell is stopped against the flange in a gun. These strong retardation forces act in the least favourable direction for the metal layers, i.e. towards the pyrotechnical composition. Even if the pyrotechnical composition is pressed against the metal layers, the mechanical strength of the metal layers in the direction towards the pyrotechnical composition is less than towards the very smooth surface of the conductive and insulating bodies (indicated by reference numeral 12 in the British Patent Application No. 15512/78), as the pyrotechnical composition consists of a pressed granular material.

The purpose of the present invention is to provide an electric igniter of the above-mentioned kind which responds slowly and at the same time has increased mechanical strength.

According to the present invention the connective member for electrically connecting the conductive bodies of the igniter includes, in addition to said metal layers, a thin layer made of an inert material, applied directly on the uppermost metal layer. The pyrotechnical composition is pressed on to the inert layer under high pressure.

The thin inert layer protects the metal layers against mechanical damage and increases the bonding of the metal layers against the underlying surface. The layer also protects the metal layers chemically by preventing corrosion.

The invention will be described in more detail, with reference to the attached drawings in which FIG. 1 is a vertical section of an electric igniter and FIG. 2 an enlarged vertical section of a part of the igniter.

The electric igniter 1 shown in FIG. 1 is mounted in an opening 2 of a wall 3 which encloses some kind of a charge of an artillery projectile, shell, rocket etc. In order to retain the igniter in the wall when the projectile is subject to high acceleration forces during firing, the opening is provided with a shoulder 4. The igniter itself comprises a wider part 5 which rests against said shoulder via an isolating sleeve 6 and which part is capable of resisting the mechanical shock which will arise during the firing operation.

The wider part 5 of the igniter comprises a lower portion 7 which serves as a connection member for connecting the igniter with a source of power.

The igniter further comprises a first body 8 in the form of a sleeve of chromium steel or other electrically conducting material. The top portion of the wider part 5 is provided with a second body 9 in the form of an elongated rod which extends coaxially inside the sleeve 8. Also this second body as well as the wider part 5 is made of an electrically conducting material, for instance iron or nickel alloy. The bodies 8 and 9 are fixed to each other by means of an electrically insulating body 10 of glass, porcelain or other similar material. The first body 8 is shaped at its lower end with a flange 11 which via an isolating ring 12 rests on the upper end surface of the wider part 5 of the igniter.

The first and second bodies 8 and 9 as well as the isolating body 10 are made with a common flat end surface 13 to which are arranged a number of layers which are not shown in detail in FIG. 1, but which are described below in connection with FIG. 2. A conventional pyrotechnical composition 14 is pressed on to the uppermost layer under high pressure. The composition is enclosed in a capsule 15 of aluminium which capsule is provided with a portion 16 which is bent over the flange 11 so that a high pressure of the pyrotechnical composition against the end surface 13 is maintained even after the pressurizing operation.

In order to retain the capsule 15 at such high retardation forces which arise when ramming a round of ammunition, a ring 17 is disposed in the opening 2, which ring firmly forces the portion 16 of the capsule against the flange 11 so that the capsule is maintained in the correct position. The ring is preferably made of stainless steel and is retained in the opening 2 by means of a deformation 18 or by means of threading in the opening 2. In order to seal the pyrotechnical composition against moisture, dust etc an O-ring 19 is disposed between the capsule 15 and the first body 8.

Figure 2:
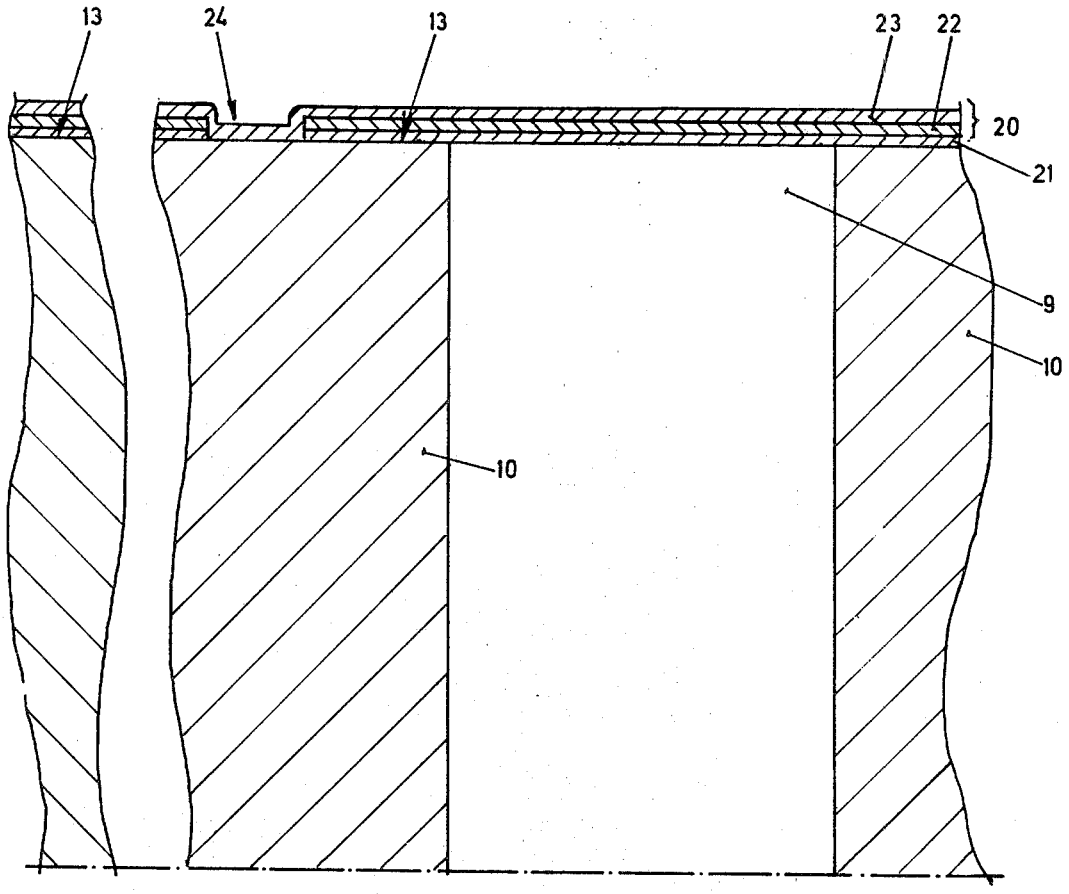

FIG. 2 shows in detail the application of the connective member 20 which electrically connects the conductive bodies 8 and 9. The connective member 20 comprises one or more comparatively thin metal layers 21, 22 which are bonded to the bodies 8 and 9 as well as the isolating body 10 because of the very smooth common surface. The bodies 8 and 9 as well as the isolating body 10 are made of material and assembled in the same way as the corresponding parts described in the British Patent Application No. 15512/78 and will therefore not be described in detail. Even the metal layers 21, 22 corresponds to the metal layers described in said British application. As the upper metal layer 22 in our new invention is protected by an additional layer of inert material 23 (see below), the requirement of corrosion resistance is not as high for this layer, as compared with the corresponding layer in the British application. This means that the upper metal layer can be made of a metal other than gold, which is mentioned in said application.

As mentioned in the introductory part of our specification there are some applications in which a somewhat "slower" electrical response of the electrical igniter is required. This can be achieved by means of an additional layer made of an inert, isolating material, for instance glass, $SiO_2$ or similar, applied on the surface 13 so that it protects the upper metal layer 22 as well as possible interruptive gaps 24 in the metal layers. The isolating layer is applied directly on the upper metal layer by means of vapourization under vacuum, i.e. the same method used for applying the metal layers. In a preferred embodiment the layer has a thickness of approx. 1 $\mu$m.

In addition to the electrical slower response, a stronger bonding of the metal layers to the surface 13 is attained by means of this additional layer. Another advantage with the additional layer is that the metal layers are not as affected by corrosion from the neighboring pyrotechnical composition. In regions which comprise interruptive gaps 24 in the metal layers this is very important as the metal layers in these regions are especially subject to mechanical and chemical damages.

We claim:

1. An electric igniter comprising:

a pair of electrically conductive bodies separated by an insulating body, said insulating body and conductive bodies forming a smooth common surface at one end thereof;

a thin connective member electrically connecting said conductive bodies, said connective member comprising:

a thin metal layer bonded on one side to said common surface, a thin layer of inert material on a remaining side of said thin metal layer; and a pyrotechnic charge in pressure contact with a free side of said thin layer of inert material whereby said charge is ignited in response to an electrical current through said connective member.

2. An electric igniter according to claim 1 in which the inert layer consists of an electrically insulating layer, $SiO_2$ applied directly on the upper metal layer by means of vaporization under vacuum.

3. An electric igniter according to claim 2 wherein the inert layer has a thickness of approx. 1 $\mu$m.

4. An electric igniter according to claim 3 wherein the pyrotechnic charge is pressed on to the inert layer by means of a capsule arranged to be retained when the igniter is subjected to high retardation stresses.

5. An electric igniter according to claim 4 wherein the capsule is kept in position by means of a part which is bent over a flange of the first body and pressed on to said flange by means of a mounting ring.

6. An electric igniter comprising:

a fuse member of conductive material having at one end thereof a portion for connection to a source of power, a wider mid portion, and a remaining narrower end portion;

an isolating sleeve adapted to support said mid portion against a shoulder in an opening of an enclosure for an artillery charge;

an insulating member surrounding said narrower end portion;

a second member of conductive material forming a sleeve coaxial with said insulating member and narrower end portion and forming a flange facing said wider mid portion, one end of said sleeve forming a common surface with said narrower end portion and insulating member;

an isolating ring separating said wider mid portion and said flange;

a connective member having an interior surface connecting said first and second members along said common surface, said connective member including first and second thin metallic layers and a thin inert material layer on an exterior surface of said connective layers; and a pyrotechnic composition, said composition held in pressure contact with said thin inert material layer by means of a capsule having first and second flanges;

said thin inert material providing a slow ignition for said pyrotechnic charge decreasing the susceptibility to accidental discharge as well as protecting said thin metallic layers from damage.

* * * * *